United States Patent [19]

Ueno et al.

[11] Patent Number: 4,624,587

[45] Date of Patent: Nov. 25, 1986

[54] ELECTRONIC TYPEWRITER WITH REMOVABLE DISPLAY CURSOR

[75] Inventors: Hideo Ueno, Nagoya; Hiroshi Kuno, Inazawa; Yoshifumi Hamabe, Chiryu, all of Japan

[73] Assignee: Brother Industries, Ltd., Nagoya, Japan

[21] Appl. No.: 669,263

[22] Filed: Nov. 7, 1984

[30] Foreign Application Priority Data

Nov. 19, 1983 [JP] Japan ..... 58-218176

[51] Int. Cl.[4] ..... B41J 3/46

[52] U.S. Cl. ..... 400/83; 340/709; 340/792; 364/521

[58] Field of Search ..... 400/83; 340/703, 709, 340/792; 364/521

[56] References Cited

U.S. PATENT DOCUMENTS 3,974,493 8/1976 de Cavaignac et al. ..... 340/709

4,527,917 7/1985 Ueno ..... 400/83

*Primary Examiner*—Edgar S. Burr

*Assistant Examiner*—David A. Wiecking

*Attorney, Agent, or Firm*—Kane, Dalsimer, Kane, Sullivan and Kurucz

[57] ABSTRACT

An electronic typewriter provided with a display unit giving visual display of data in a number of positions of characters shorter in length than one line of characters printed on a sheet of paper which includes a cursor for indicating the next following position of data input. The cursor may be shifted out of the display unit when necessary, and when the data imputted to the last position in the display unit is dead key data, the position of the dead key data is indicated by the cursor, so that the display unit can display data greater by one character than display units of the prior art.

1 Claim, 6 Drawing Figures

ELECTRONIC TYPEWRITER WITH REMOVABLE DISPLAY CURSOR

BACKGROUND OF THE INVENTION (1) Field of the Invention

This invention relates to an electronic typewriter provided with a display unit capable of giving visual display of information expressed in a number of positions of characters shorter in length than one line of characters printed on a sheet of paper.

(2) Description of the Prior Art

In the type of electronic typewriter described, the display unit is usually provided with a cursor for indicating the next following key input position. In this type of electronic typewriter of the prior art, when the cursor has moved to the last position of the character in the display unit as data has successively been inputted, it has hitherto been impossible to display the next following character of the data in the last position because the last position is used for displaying the cursor. Thus, this type of electronic typewriter of the prior art has suffered the disadvantage that the number of characters in which inputted data can be actually displayed by the display unit is smaller by one character than the number of positions of characters provided by the display unit.

SUMMARY OF THE INVENTION (1) Object of the Invention

This invention has been developed for the purpose of obviating the aforesaid disadvantage of the prior art. Accordingly, the invention has as its object the provision of a novel electronic typewriter provided with a display unit capable of making effective use of all the number of positions of characters provided by the display unit to enable inputted data greater by one character than has hitherto been the case to be displayed, wherein control is effected in such a manner that when dead key data is inputted to the last position of the character, the cursor indicates the position of the dead key data whereby a character having umlaut ( ) or other mark attached thereto can be inputted without any trouble.

(2) Statement of the Invention

According to the invention, there is provided an electronic typewriter provided with a display unit capable of giving visual display of data by using a number of characters shorter in length than one line of characters printed on a sheet of paper and operative to successively shift out inputted data starting with the initially inputted data when the inputted data becomes greater than the number of positions of characters that can be displayed, such typewriter comprising: a cursor located in the display unit for indicating the next following key input position therein, and a control unit for controlling the display unit in such a manner that when the next following data is inputted to the display unit after the cursor has moved to the last position of the character as data has been successively inputted, the cursor is moved outside the display unit, and that when the data inputted for the last time is dead key data, visual display is given of the position of the dead key data.

Additional and other objects, features and advantages of the invention will become apparent from the description set forth hereinafter when considered in conjunction with the accompanying drawings.

DESCRIPTION OF THE PREFERRED EMBODIMENT

Figure 1:
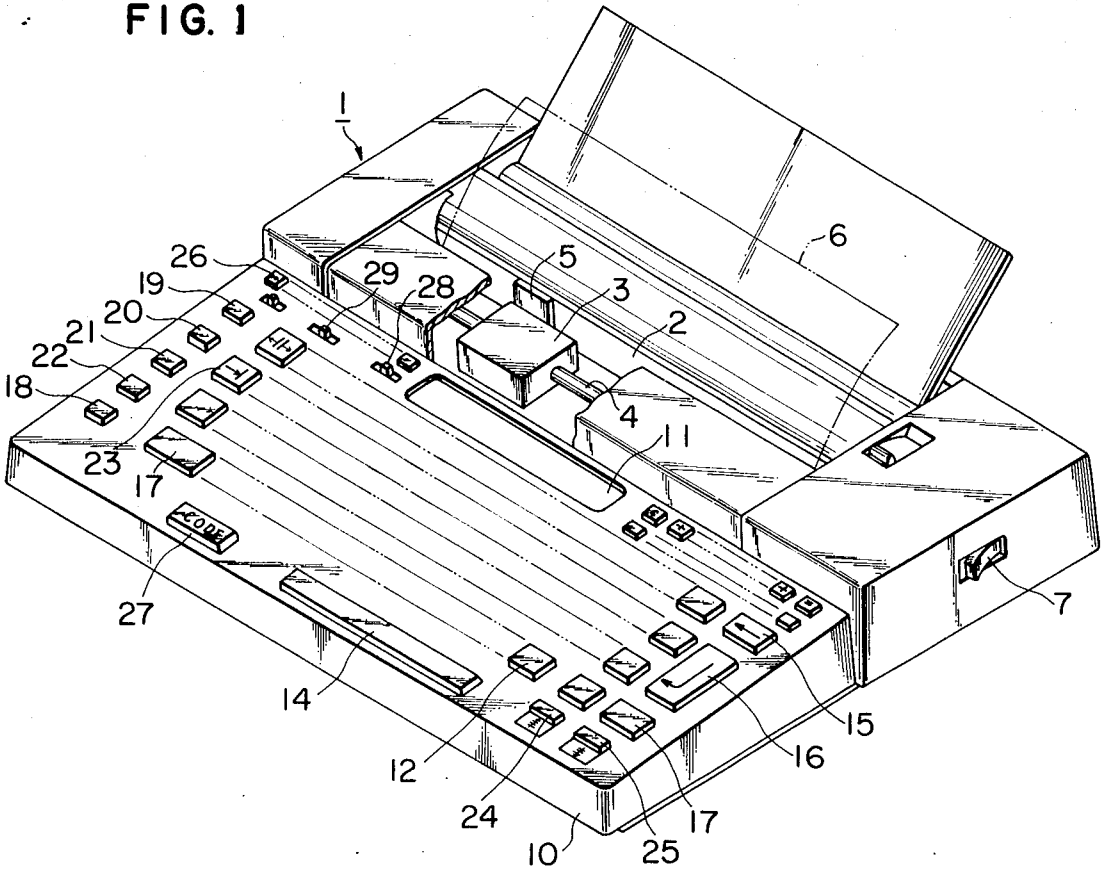
FIG. 1 is a perspective view of an electronic typewriter incorporating the present invention therein, showing its external appearance.
Figure 2:
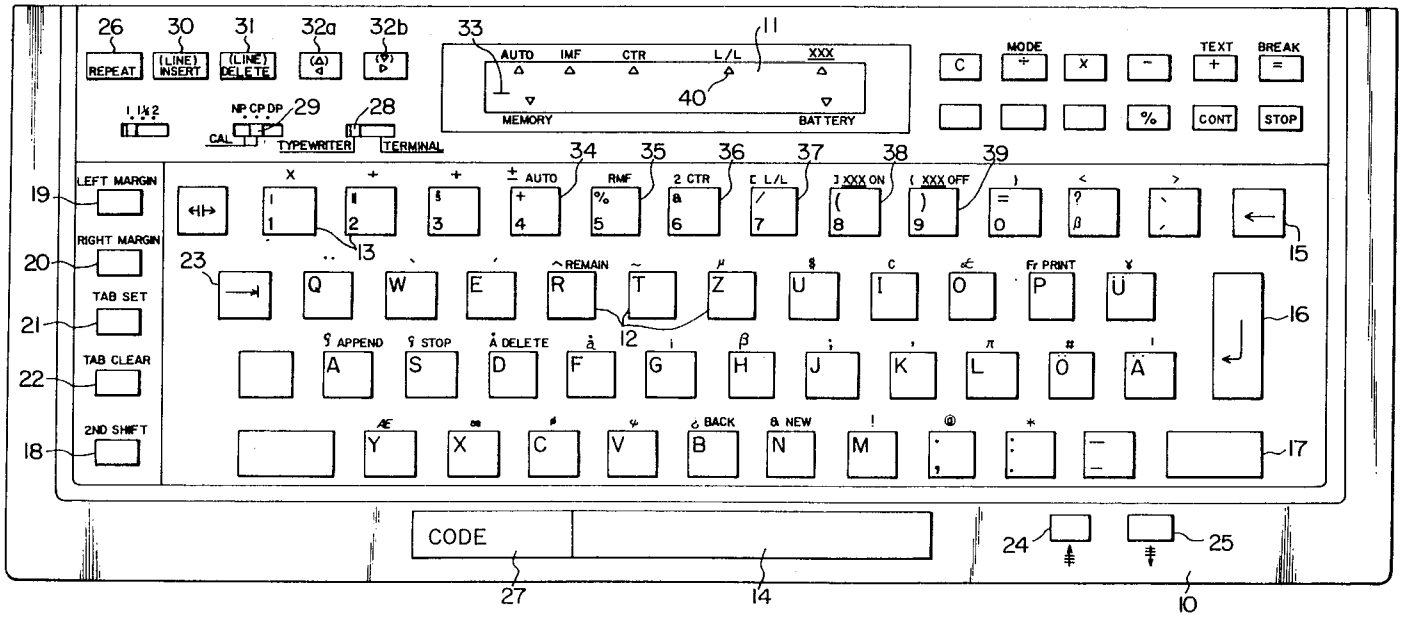
FIG. 2 is a plan view of the keyboard section of the electronic typewriter shown in FIG. 1.

The electronic typewriter shown in FIG. 1 comprises a case 1 supporting a platen 2 extending from side to side in a rear portion of the case 1, and a guide rod 4 located forwardly of the platen 2 and extending parallel thereto. A carriage 3 is supported by the guide rod 4 for movement along the platen 2 and rotation about the guide rod 4. Mounted to the carriage 3 is a thermal head 5 which is movable between a printing position in which the thermal head 5 presses against a sheet of heat-sensitive paper 6 on the platen 2 as the carriage rotates and an inoperative position in which the thermal head 5 is out of engagement with the sheet of heat-sensitive paper 6. A main switch 7 connected to a power source is provided to the case 1.

A keyboard section 10 is located in a front portion of the case 1, and a liquid crystal display (LCD) unit 11 is located in the keyboard section 10 for giving visual display of information in a number of positions of characters shorter in length than one line of characters printed on the sheet of heat-sensitive paper 6 (the number of positions of characters is 15 in this embodiment). The keyboard section 10 includes a multiplicity of keys, switches and other members for operating the typewriter.

More specifically, the keys and switches located at the keyboard section 20 comprise alphabet keys 12 for inputting alphabets, digit keys 13 for inputting digits 0–9 and a space key 14 which are character and symbol keys. Other keys and switches include a back space key 15, a carriage return key 16, a shift key 17, a second shift key 18, a left margin set key 19, a right margin set key 20, a tab set key 21, a tab clear key 22, a tab key 23, a line feed key 24 for advancing the sheet of heat-sensitive paper 6, a back line feed key 25 for moving the sheet of heat-sensitive paper 6 backwardly, a repeat key 26, a code key 27, first and second mode selection switches 28 and 29, an insert key 30, a delete key 31, and cursor shift keys **32*a* and 32*b* for shifting a cursor 33 for indicating the next following key input position in the display unit 11**.

Of these keys and switches, the code key 27 functions such that when it is actuated together with any one of digit keys 34–39 corresponding to various printing functions such as an automatic carriage return mode, a right margin flush mode, a centering mode, a line-by-line mode, an underlining on mode and an underlining off mode, respectively, it selects a different printing function by producing code data distinct from the code data produced when it is actuated singly.

In the line-by-line mode, the printing function performed by the typewriter is to correct inputted data in the range of one line. In the right margin flush mode, the printing function performed by the typewriter is to perform printing by bringing the characters of various lines into positions in which they are flush with the right margin position. In the centering mode, the typewriter performs the function of printing a character in a central portion between the left and right margin positions while a printing operation is being performed. In the automatic underlining mode, the printing function performed by the typewriter is to underline characters simultaneously as they are printed.

The first mode selection switch 28 is a two-position-slide type switch for selecting one of a typewriting mode and a terminal mode. The typewriting mode is one in which the typewriter functions as an ordinary typewriter. In the terminal mode, the typewriter is used as a data terminal.

The second mode selection switch 29 is three-position-slide type switch for selecting one of a non-printing mode, a correction printing mode and a direct printing mode. In the non-printing mode, characters or other symbols inputted by means of keys are displayed by the liquid crystal display unit 11 without being printed by the thermal head 5. In the correction printing mode, characters and other symbols inputted by means of keys are displayed by the liquid crystal display unit 11 and when the inputted data has become greater than the number of characters that can be displayed by the display unit 11, inputted data is successively shifted out of the display unit 11 starting with the initially inputted data and printed on the sheet of heat-sensitive paper 6 by means of the thermal head 5. The direct printing mode is one in which characters and other symbols inputted by means of keys are displayed by the liquid crystal display unit 11 simultaneously as they are printed on the sheet of heat-sensitive paper 6 by means of the thermal head 5.

Other keys than those described hereinabove are similar of those of ordinary typewriters, so that their detailed description shall be omitted.

Marks (AUTO, RMF, CTR, L/L, XXX ON and XXX OFF) indicating the various functions of the electronic type-writer corresponding to the various digit keys 34–39 are set at an outer marginal portion of the liquid crystal display unit 11 and above the top surfaces of the keys 34–39. Guidons 40 corresponding to these marks are arranged in the liquid crystal display unit 11.

Figure 3:
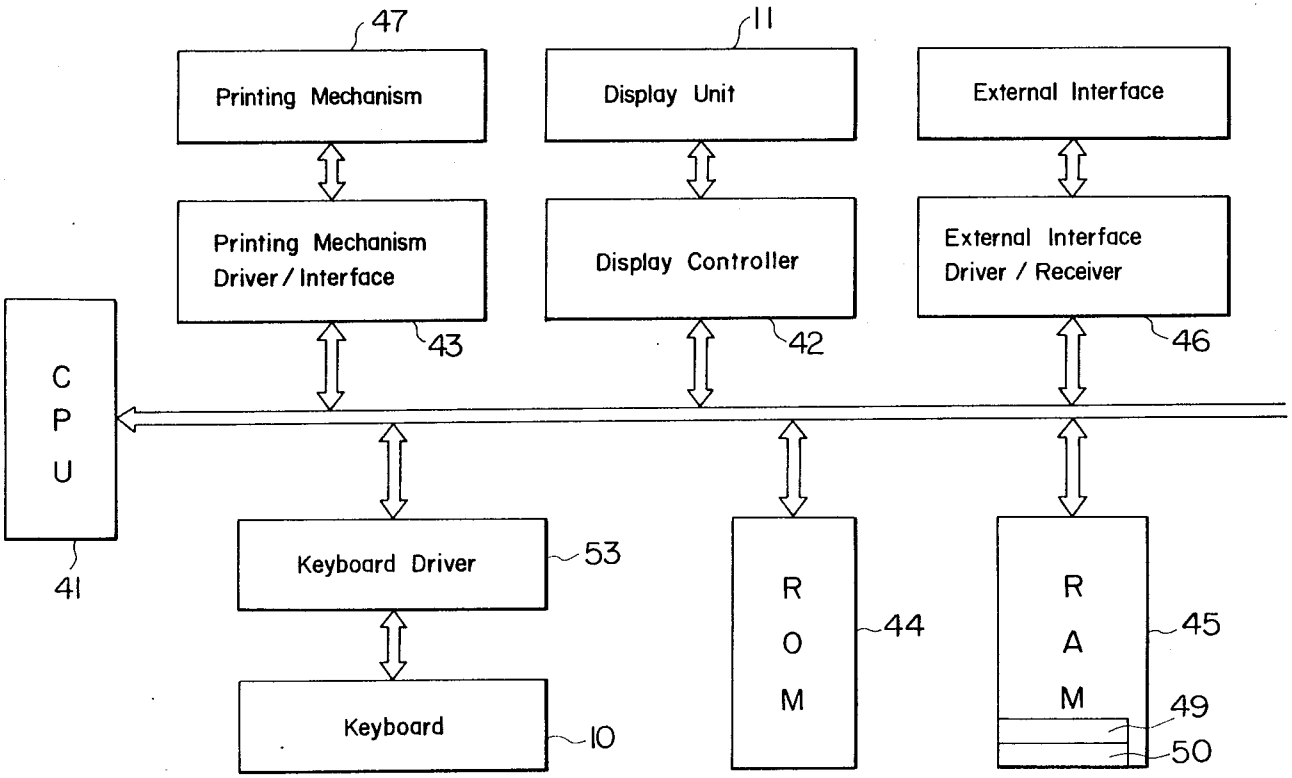
FIG. 3 is a block diagram of the electronic circuit of the typewriter shown in FIG. 1.

The electronic circuit of the typewriter of the above-noted construction will be described by referring to FIG. 3, in which the reference numeral 41 designates a central processing unit (CPU) to which the keyboard section 10 is connected via a keyboard driver 53. Also connected to the CPU 41 are a display controller 42 connected to the liquid crystal display unit 11, a printing mechanism driver/interface 43 connected to a printing mechanism 47, an external interface driver/receiver 46 connected to an external interface, a read-only-memory (ROM) 44 and a random-access-memory (RAM) 45. The liquid crystal display unit 11 and display controller 42 constitute a display system. The printing mechanism 47 and printing mechanism driver/interface 43 constitute a printer section. The printing mechanism 47 comprises the platen 2, carriage 3, means for driving the platen 2 and carriage 3, and the thermal head 5.

The CPU 41 performs the functions of causing the RAM 45 to successively store various data corresponding to characters inputted by means of the keys of the keyboard section 10 including alphabets, digits, space marks, symbols of logical and arithmetic operations and other symbols, and reading out of the ROM 44 pattern data corresponding to the inputted code data and supplying same to the display controller 42 and printing mechanism driver/interface 43. The display controller 42 causes the liquid crystal display unit 11 to give visual display of characters based on the pattern data supplied from the CPU 41 and causes the cursor 33 to be indicated in a position next to the positions in which characters are indicated in the unit 11. When the position in which the inputted data are indicated is the last position of the character to be indicated at the display unit 11, the cursor 33 is made to disappear from the display unit 11 as if it were made to move outside the unit 11. The CPU 41 also has the function of driving the thermal head 5 of the printing mechanism 47 based on the pattern data read out of the ROM 44 and a motor, not shown, for driving the platen 2 and carriage 3. The RAM 45 is provided with an input buffer memory 49 for temporarily storing the inputted character data and function data, and a text memory 50 for storing character data and function data on several sheets of A4 type paper.

Figure 5:
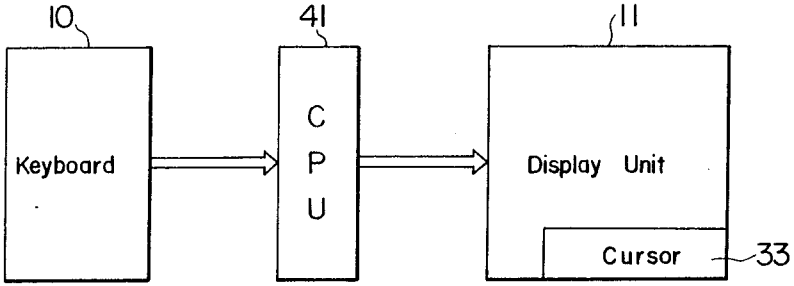
FIG. 5 is a view in explanation of the manner in which various parts concerned in the feature of the invention are connected together.

FIG. 5 shows parts concerned in the present invention. The CPU serves as a control unit connected to the display unit 11 capable of giving visual display of information in a number of position of characters shorter in length than one line of characters printed on a sheet of paper. The cursor 33 for displaying the next following key input position is provided to the display unit 11. As data is inputted under control effected by the control unit, the cursor 33 moves from an initiating position to a terminating position at the display unit 11. When the next following data is inputted to the display unit 11 after the cursor 33 has moved to the terminating position, the cursor 33 is shifted out of the unit 11 and indicates, when the finally inputted data is dead key data, the position of the dead key data.

Figure 6:
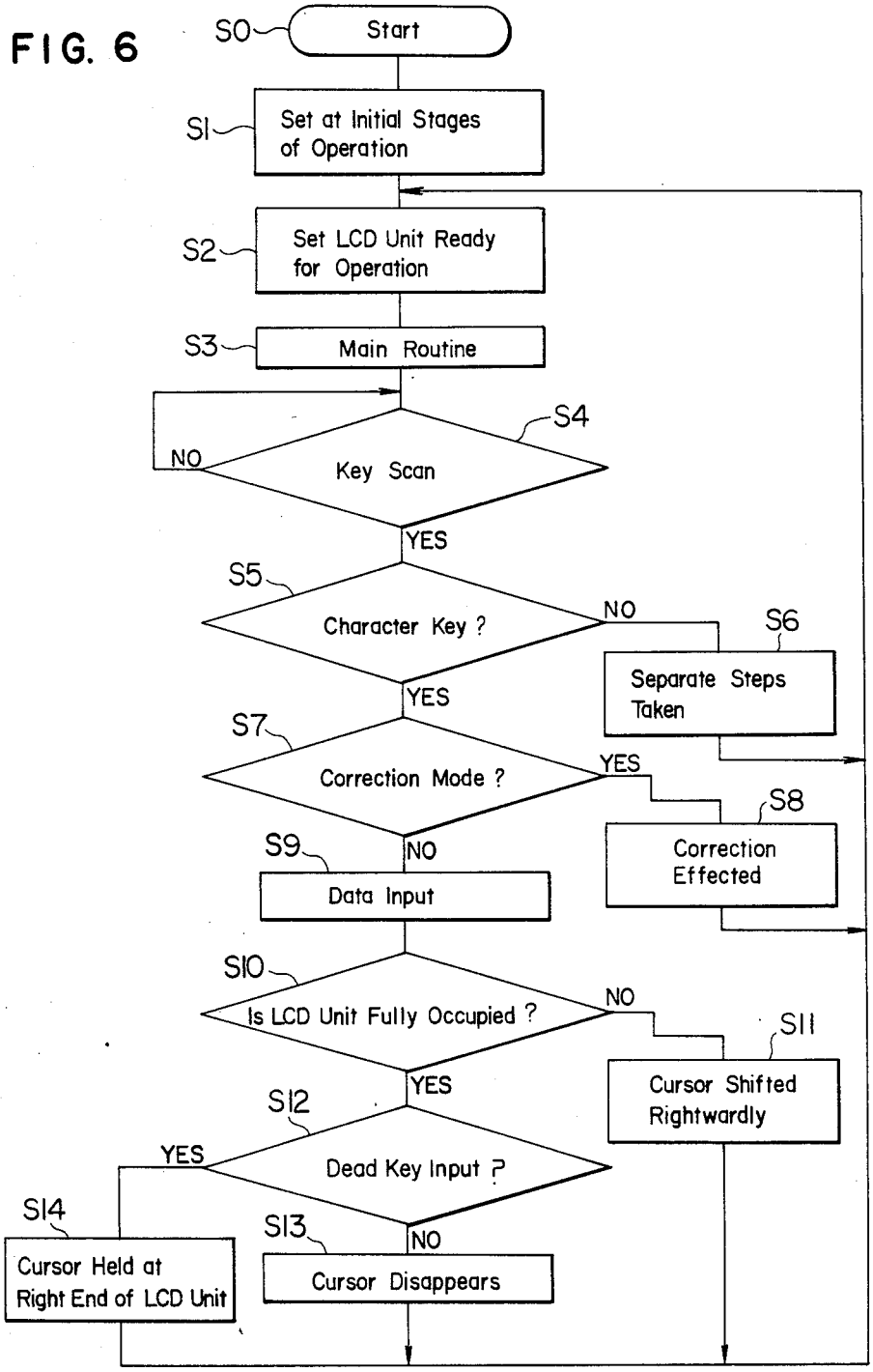
FIG. 6 is a flow chart showing the operation of the feature of the invention.

Operation of the typewriter relating to the feature of the invention will be described by referring to Fig. 6.

In step S0, the typewriter is connected to a power source to start operating. In step S1, the carriage 3 is shifted to the left margin position, and the display controller 42 and RAM 45 are set at their initial stages of operation. In step S2, the liquid crystal display unit 11 is set at a condition ready to start a display. In step S3, a main routine is performed to carry out printing based on the inputted data. In step S4, judgment is passed as to whether various keys have been actuated. If the judgment is NO, then a key scan is repeatedly performed. If the judgment is YES, the operation proceeds to step S5 in which judgment is passed as to whether the keys actuated in step S4 were character keys. If the judgment is NO, then necessary steps are taken separately for the actuated keys in step S6. No visual display of the data is given by the display unit 11.

If the keys actuated in step S4 were character keys, then the judgment passed in step S5 is YES and the operation proceeds to step S7 in which judgment is passed as to whether a correction mode has been instituted or whether the cursor shift keys **32*a* and 32*b* have been actuated to cause the cursor 33 to indicate the position of the data already inputted. When the actuation of the character keys in step S4 took place in the correction mode, the operation returns to step S2 after a correction is made in step S8 in the display made by the display unit 11. If no correction mode was instituted when the character keys were actuated, then a data input takes place in step S9, so that character data corresponding to the actuated character keys is stored in the input buffer memory 49 of the RAM 45 and is displayed by the liquid crystal display unit 11. The cursor 33** is indicated below the position which is next to the position in which the data pattern is being displayed.

In step S10, judgment is passed as to whether information is being displayed in all the positions of characters in the liquid crystal display unit 11. If there are any positions in which data can be displayed, then the judgment passed is NO, and the operation proceeds from step S10 to step S11 and the cursor 33 is shifted to a position rightwardly of the position in which the last data is indicated, to wait for the next following characters to be inputted by key actuation. When the cursor 33 has moved to the last position in the display unit 11 as shown in FIG. 4(*a*) following a data input, the judgment passed in step S10 is YES, and, in step S12, judgment is passed as to whether the character inputted to occupy the last position in the display unit 11 is dead key data, such as umlaut ( ), accent grace ( ), accent aigu ( ), or other similar mark or a character key input.

Figure 4:
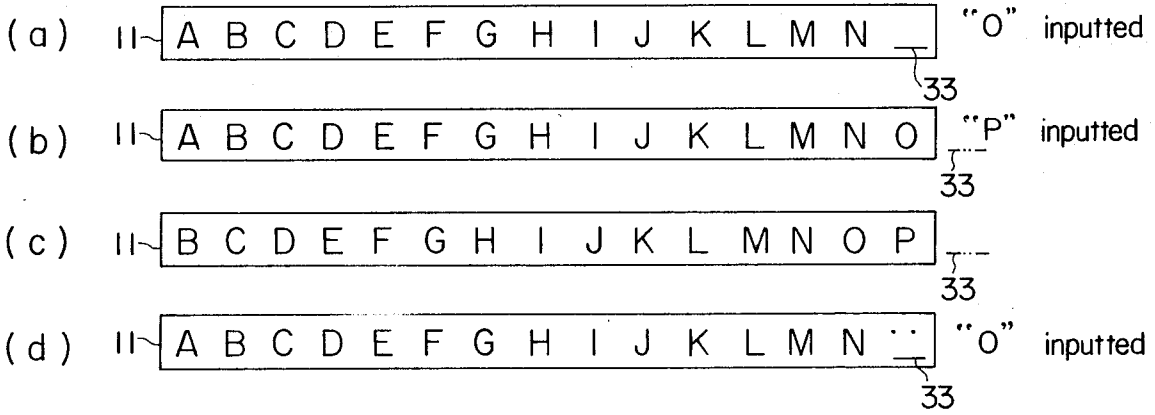
FIG. 4 is a view in explanation of the operation of the feature of the invention.

When it is desired to input "O" to the last position in the display unit 11 as shown in FIG. 4(*b*), the operation proceeds to step S13 because the judgment passed in step S12 is NO since the inputted character is not dead key data. Thus, the cursor 33 disappears as if it moved out of the display unit 11. At this time, if the next following character "P" is inputted by the operator who actuates the key to indicate the character in the last position as if the character "P" were going to be superposed on the cursor 33 although the cursor 33 is not actually indicated by the display unit 11, then the inputted character "P" is indicated in the last position of character as shown in FIG. 4(*c*) while the character "A" in the first position of character in the display unit 11 is shifted leftwardly out of the display unit 11. Thus, if the cursor 33 is shifted out of the display unit 11 as the next following data is inputted when the cursor 33 is disposed in the last position of character in the display unit 11, then it is possible to display the desired character in the last position of character in the display unit 11 without being interfered with by the cursor 33. Therefore, the electronic typewriter provided with a display unit according to the invention is capable of giving visual display of a number of characters greater by one character than the corresponding type of typewriter of the prior art.

Also, according to the invention, when dead key data or the mark umlaut ( ) is inputted to the last position in the display unit 11 in a condition shown in FIG. 4(*a*), the judgment passed in step S12 is YES and the operation proceeds to step S14 in which the mark umlaut ( ) is indicated in the last position of character as shown in FIG. 4(*d*) while the cursor 33 is also indicated below the mark unlaut ( ) without disappearing, unlike in step S13 in which the cursor 33 has disappeared. Thus, if the operator inputs the next following character "O" to the last position of character in superposed relation to the cursor 33, then it is possible for the operator to indicate the character (Ö) in the last position of character in the display unit 11 without any trouble. The cursor 33 never fails to perform its original function of indicating the next following key input position in the display unit 11, even if it is made to operate as described hereinabove in the present invention.

From the foregoing description, it will be appreciated that in the present invention, when the next following data except dead key data in inputted after the cursor has reached the last position of character in the display unit following successive data inputs, the cursor is shifted out of the display unit and, if the data inputted to the last position of character is dead key data, then the cursor indicates the position of the dead key data. Thus, the invention enables the display unit to give visual display of a number of characters greater by one character than the display unit of the prior art. In addition, a character having the mark umlaut ( ), for example, can be inputted just like ordinary characters without any trouble.

What is claimed is:

1. An electronic typewriter for printing a line of consecutive characters on a sheet of paper comprising:

a display unit having a number of positions provided to display one of a character and a cursor, the number of positions being less than a maximum number of characters forming said line;

a keyboard with keys for selecting the characters to be printed;

control means operatively connected to said display unit and said keyboard, said control means including circuit means for determining if said cursor is located in the rightward-most position of said display unit, for moving said cursor off the display unit if the next data inputted is character key data and for holding said cursor in the righward-most position if the next data inputted is dead key dead-key data.

* * * * *